US005169584A

United States Patent [19]

Ross et al.

[11] Patent Number: 5,169,584

[45] Date of Patent: Dec. 8, 1992

[54] METHOD OF MAKING SMALL DIAMETER HIGH STRENGTH CARBON FIBERS

[75] Inventors: Roger A. Ross, Chattanooga; Uel D. Jennings, Signal Mountain, both of Tenn.

[73] Assignee: E. I. Du Pont de Nemours and Company, Wilmington, Del.

[21] Appl. No.: 606,660

[22] Filed: Oct. 31, 1990

Related U.S. Application Data

[63] Continuation-in-part of Ser. No. 311,511, Feb. 16, 1989, abandoned.

[51] Int. Cl.[5] ..... D01D 4/00; D01F 9/12

[52] U.S. Cl. ..... 264/211.110; 264/29.2; 425/464

[58] Field of Search ..... 264/211.11, 29.2; 425/464, 465

[56] References Cited

U.S. PATENT DOCUMENTS

| | | | |
|---|---|---|---|
| 4,331,620 | 5/1982 | Diefendorf et al. | 264/29.2 |
| 4,376,747 | 3/1983 | Nazem | 264/29.2 X |
| 4,480,977 | 11/1984 | Nazem | 425/192 S |
| 4,511,625 | 4/1985 | Nazem et al. | 264/29.2 X |
| 4,576,811 | 3/1986 | Riggs et al. | 264/29.2 X |
| 4,628,001 | 12/1986 | Sasaki et al. | 428/367 |
| 4,717,331 | 1/1988 | Maeda et al. | 425/467 |
| 4,775,589 | 10/1988 | Hamada et al. | 428/367 |
| 4,814,121 | 3/1989 | Watanabe | 264/29.2 |
| 4,818,449 | 4/1989 | Yamada et al. | 264/29.2 |
| 4,818,612 | 4/1989 | Hara et al. | 428/367 |
| 4,859,381 | 8/1989 | Morita et al. | 264/29.2 |
| 4,913,889 | 4/1990 | Takai et al. | 423/447.1 |
| 4,915,926 | 4/1990 | Lahijani | 423/447.1 |

FOREIGN PATENT DOCUMENTS

| | | | |
|---|---|---|---|
| 263358 | 4/1988 | European Pat. Off. . | |
| 294112 | 12/1988 | European Pat. Off. . | |
| 60-252723 | 12/1985 | Japan | 264/29.2 |

OTHER PUBLICATIONS

English-Language Translation of Japanese Reference 59-168,127 (published Sep. 1984).

English-Language Translation of Japanese Reference 61-75,820 (published Apr. 1986).

English-Language Translation of Japanese Reference 61-75,821 (published Apr. 1986).

English-Language Translation of Japanese Reference 61-113,828 (published May 1986).

English-Language Translation of Japanese Reference 62-131,034 (published Jun. 1987), Tables 1 and 2.

English-Language Translation of Japanese Reference 63-105,116 (published May 1988).

English-Language Translation of Japanese Reference 63-303,121 (published Dec. 1988).

*Primary Examiner*—Leo B. Tentoni

[57] ABSTRACT

Small diameter high strength carbon fibers are produced in a process in which the spinneret has a small diameter, the spinneret capillary temperature is at least 10° C. higher than the predicted spin temperature of the pitch and the pitch flows through a high aspect ratio opening upstream of the spinneret.

9 Claims, 1 Drawing Sheet

METHOD OF MAKING SMALL DIAMETER HIGH STRENGTH CARBON FIBERS

This invention is a continuation-in-part of U.S. Ser. No. 07/311,511 filed Feb. 16, 1989.

BACKGROUND OF THE INVENTION

This invention relates to an improved process for making continuous high strength small diameter carbon fibers, and to the fibers made by the process.

Carbon fibers made from mesophase pitch offer desirable properties such as high strength and high modulus. U.S. Pat. No. 4,915,926 discloses process conditions leading to a balance of high strength and high modulus in carbon fibers, but while this patent mentions fibers as small as 5 micrometers in diameter, (see column 5, line 51) the conditions taught therein are not specifically optimized for producing small diameter fibers. U.S. Pat. No. 4,913,889 reports production of carbon fibers having very good strengths and modulus parameters, but because the process employed requires the use of spinnerets with flared outlets, it appears improbable that small diameter carbon fibers could be produced. In spite of the teaching in the art, small diameter continuous pitch based carbon fibers have not been readily commercially available.

Small diameter carbon fibers are desired because they should follow the general relationship of increasing strength with decreasing diameter. However, any process for such small diameter fibers must overcome the problem of the formation of strength reducing axial cracks in pitch based carbon fibers which is well recognized in the art. Small diameter fibers are also sought since the manufacture of carbon fibers involves heat treatments, smaller diameter fibers can be heat treated more efficiently than larger fibers. This invention provides novel continuous pitch based small diameter carbon fibers and a process especially tailored for producing small diameter high tenacity carbon fibers.

SUMMARY OF THE INVENTION

Figure 1:
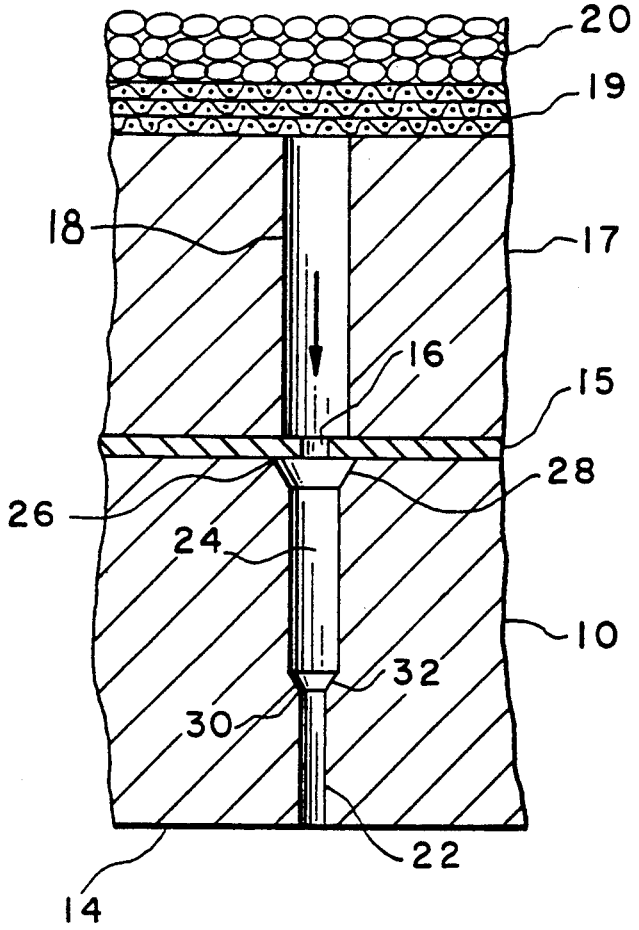
FIG. 1 is a partial schematic section of a melt spinning pack useful in the practice of this invention.

The process of this invention involves spinning mesophase pitch through a spinneret having a round cross-section capillary and a round cross-section counterbore upstream of the capillary, the counterbore being larger in cross-section than the capillary. To avoid axial cracking in the fibers it is necessary to place at the inlet of the spinneret an opening which has a high aspect ratio, and an area substantially larger than the cross-sectional area of the capillary. The opening may be trapezoidal, elliptical, a parallelogram or the like. Rectangular openings are preferred. Aspect ratios (length:width) of at least 3:1 are preferred with ratios of at least 5:1 being more preferred. It is preferred that the width of the opening be approximately equal to the diameter of the capillary.

Preferred openings have a depth of at least 0.005 inches with more preferred openings having a depth of from 0.01 to 0.02 inches. Preferably the opening should be formed from a plate having a thickness selected so that at the spinning rate used, the pitch has a residence time in the opening of at least 0.03 seconds. Residence times of 0.03 to 0.24 seconds are preferred, with times in the range of 0.06 to 0.20 seconds more preferred. However, the benefits of this invention are not lost if deeper openings providing longer residence times are employed.

The process of this invention is capable of producing strong continuous substantially round cross-section carbon fibers having a diameter of 3 to 8, or preferably 5 to 8 micrometers. The fibers produced using optimized production parameters are free of axial cracking and exhibit a tensile strength of at least 500 Kpsi. Fibers will generally exhibit strengths in the range of 500 to 800 Kpsi, but strengths as high as 1000 Kpsi may be attained. The fibers of this invention, when viewed with a scanning electron microscope in cross-section predominantly exhibit a series of lines, one straight line through the center of the cross-section with additional lines on either side of the center line which do not intersect the center line or one another, but which approach the center line near its center and bend away from the center line near the periphery of the cross-section.

In order to effectively produce the small diameter carbon fibers of this invention, it is preferred that the diameter of the capillary of the spinneret should be from 0.004 to 0.010 inches, with a capillary diameter range of from 0.005 to 0.007 inches being more preferred.

To facilitate production of small diameter high strength carbon fibers, it is preferable to spin the mesophase pitch at a higher temperature than is required for larger diameter fibers. The carbon fibers should be spun at a spinneret capillary temperature at least 103° higher than the predicted spin temperature of the mesophase pitch. It is preferred that the spinneret capillary temperature be in the range of 10° to 25° C. higher than the predicted spin temperature of the pitch, and more preferred that the spinneret capillary temperature be about 15° C. higher than the predicted spin temperature of the pitch. The predicted spin temperature of any batch of pitch is the temperature at which the pitch exhibits a viscosity of 630 poise as measured using an Instron capillary viscometer.

The fibers made by the process of this invention are particularly useful as reinforcing elements in metal, ceramic and plastic matrices.

DETAILED DESCRIPTION OF THE INVENTION

The invention will be further explained by referring to the drawings. FIG. 1 shows in schematic cross-section a spinning pack useful in the practice of this invention. The pack consists of spinneret 10, shim 15, distribution plate 17 and screen pack 19 supporting filtration medium 20, which is described in U.S. Pat. No. 3,896,028 (Phillips). The screen and filtration medium are optional elements. Associated support, gasketing, heating and enclosing means are not shown in FIG. 1. Molten pitch supplied externally (means not shown) flows through the pack elements in the reverse order and is successively filtered through 20, is directed to one of a plurality of spinneret counterbores 24 via one of a plurality of coaxial holes 18 in distribution plate 17, passes through the opening 16 in shim 15 which forms the flow of pitch into a ribbon configuration. The pitch is then extruded through the spinneret capillary 22. Refinements in the spinneret 10 consist of wide entrance 26 which has tapering neck 28 leading to counterbore 24. Counterbore 24 communicates with capillary 22 via entrance 30 with tapering neck 32. FIG. 3 of U.S. Pat.

Figure 2:
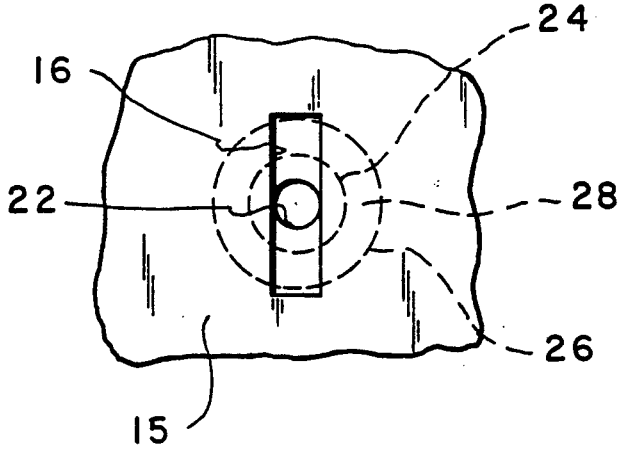
FIG. 2 is a view through the spinneret showing the rectangular opening to the spinneret.

No. 4,576,811 describes in detail the capillary entrance 30 and features within the tapering neck 32. Reference to FIG. 2 further details the alignment of high aspect ratio opening 16 (which in this preferred embodiment is rectangular) of shim 15 to the axis of capillary 22 in the spinneret 10. This arrangement is repeated for each of the many capillaries in the spinneret, and provides the beneficial formation of molten pitch flow into a ribbon configuration in its path from the distribution plate 17 to the spinneret 10. The pitch flow stream generally remains within a plane that includes the axis of the spinneret capillary 22. The drawings show a shim plate separate from the body of the spinneret used to provide the beneficial flow configuring opening. However other arrangements in which the high aspect ratio opening is incorporated in the spinneret body are within the scope of this invention.

It is preferred that the opening provide a reduction in cross-sectional area of pitch flow, as compared to the spinneret counterbore area, of about 10%–70%, with from about 25% to 45% preferred. If the flow configuring opening is too wide (i.e., the shim opening has too low an aspect ratio) the benefits of the invention may not be obtained. If the flow restriction is too great (i.e., the shim opening is too narrow) process continuity may be impacted. The aspect ratio may be 25:1 or more, provided the continuous flow of pitch through the opening is not impeded. The rectangular geometry is the preferred flow configuration, but other configurations providing substantially ribbon-like flow may be used. An improvement in fiber properties is derived from the use of the high aspect ratio opening upstream from the spinneret, regardless of the thickness of the shim in which the opening is formed. However, fiber properties are optimized if the thickness of the shim, and hence the depth of the opening, is selected so that the average residence time of the pitch in the opening is at least 0.03 seconds. Preferred residence times are from 0.06 to 0.20 seconds, but longer residence times do not detract from the benefits of this invention. In general, a depth of at least 0.005 inches is preferred with 0.01 to 0.02 inches being more preferred. Equipment used to prepare pitch carbon fibers has in general evolved empirically from the larger body of melt-spinning art. Basic understanding has often lagged such development. What is understood, however, is that molten pitch, a discotic liquid crystalline material, has quite long relaxation times ("memory") relative to conventional organic polymers and that this property is very likely responsible for the beneficial results achieved by the practice of this invention.

The long relaxation time of pitch probably also accounts for a slight variation from circular cross-sections observed in fibers produced by the process of this invention. While the fibers are substantially round, the fibers, particularly the larger diameter fibers, spun through a rectangular opening upstream of the round spinneret exhibit a slight oval shape. They have an aspect ratio of 1.1 or less. That is, the longer dimension of the cross-section is 1.1 or less larger than the shorter dimension of the cross-section.

In order to produce small diameter high strength carbon fibers, it is preferred that the spinneret capillary have a diameter of from 0.004 to 0.010 inches, or more preferably from 0.005 to 0.007 inches, and most preferably a diameter of about 0.006 inches.

Production of high strength small diameter fibers is facilitated by spinning the pitch at a higher temperature than is used in the production of larger diameter fibers. The preferred spinneret capillary temperatures of the process of this invention are at least 10° C. higher than the predicted spin temperature of the pitch. More preferably the spinneret capillary temperature should be in the range of 10° to 25° C. higher than the predicted spin temperature, with an approximate temperature of 15° C. higher than the predicted spin temperature being most preferred. The predicted spin temperature is that temperature at which the pitch exhibits a melt viscosity of 630 poise, measured using an Instron capillary viscometer.

In order to conveniently use actual spinning temperatures sufficiently higher than the predicted spin temperature of the pitch to obtain fibers with optimum strength and of the desired small diameter, it may be necessary to adjust the process of pitch preparation to produce pitch which has a somewhat lower predicted spin temperature. For example if the pitch preparation procedure set out in Greenwood U.S. Pat. No. 4,277,324 is used, the solvent:anti-solvent ratio is decreased to produce a pitch with a lower predicted spin temperature. The disclosure of U.S. Pat. No. 4,277,324 is incorporated herein by reference. In general pitches with a predicted spin temperature of from 330° to 353° C. are preferred for producing small diameter carbon fibers from mesophase pitch. More preferred pitches exhibit a predicted spin temperature of from about 345° to 350° C. Pitches with higher predicted spin temperatures usually require a larger difference between predicted and actual spin temperatures in order to achieve significant attenuation in the spinning process. Pitches with predicted spin temperatures below the preferred range usually require extended stabilization times.

Subsequent to spinning in the manner described, fiber stabilization, carbonization and optional graphitization is carried out conventionally. Subsequent to preparing the as-spun or "green" filaments or yarns as described above, a finish (either fugitive or durable) may be applied to ease handling and/or provide protection. Stabilization in air is generally conducted between 250° and 380° C. and on bobbins (see, e.g., U.S. Pat. No. 4,527,754) preferably following the procedure disclosed in U.S. Pat. No. 4,576,811. Smaller diameter fibers can be stabilized more quickly than larger fibers.

After stabilization, the yarns or fibers can be devolatilized or "precarbonized" in an inert atmosphere at temperatures between 800° and 1000° C. so that subsequent carbonization may proceed more smoothly and that formation of strength-limiting voids is reduced or eliminated entirely. Precarbonization is usually accomplished with 0.1 to 1 minute. Carbonization in inert atmosphere is carried out at 1000° to 2000° C. and preferably between 1500°–1950° C. for about 0.3 to 3 minutes. At this point a surface treatment and/or finish application may be beneficial to improve fiber performance, e.g., adhesion, in its eventual application, e.g.,in a composite. Graphitization, if desired, is usually accomplished in an inert atmosphere by heating between 2400° and 3300° C., preferably between 2600°–3000° C. for at least about a minute. During any of the above-mentioned heating steps, longer times of treatment do not appear to be detrimental.

The invention will be more fully understood by reference to the following non-limiting examples.

EXAMPLE 1

Midcontinent refinery decant oil was topped to produce an 850° F. plus residue. The residue analyzed 91.8% carbon, 6.5% hydrogen, 35.1% Conradson carbon residue and 81.6% aromatic carbon by $C^{13}$ NMR. The decant oil residue was heat soaked 6.3 hours at 740° F., and then vacuum deoiled to produce a heat soaked pitch. This pitch tested 16.4% tetrahydrofuran insolubles (1 gram pitch in 20 ml THF at 75° F.).

The pitch so obtained was pulverized, fluxed with toluene (1:1 weight ratio of solvent to pitch) by heating to the reflux temperature for about one hour. The solution was passed through a 1 micron filter, and admixed with sufficient toluene/heptane (79:21) ("anti-solvent") to provide (a) an 81:19 by volume toluene/heptane mixture and (b) an 8:1 mixed solvent/pitch ratio, by volume/weight.

After refluxing for 1 hour, the mixture was cooled to ambient temperature and the precipitated solids were isolated by filtration. The cake was washed with additional anti-solvent followed by heptane and then dried Several such batches were blended, melted at about 420° C., passed through a 2 micron filter, and extruded into pellets. At this point, the pitch pellets have a quinoline insolubles (ASTM 75° C.) of less than 0.1% by weight and are 100% mesophase, as determined by the polarized light microscopy method, and have a predicted spin temperature of 348° C.

The pellets were remelted in a nitrogen sparged chamber and then extruded through a 3 inch/10 hole spinneret. The spinneret was externally heated to result in a spinneret capillary temperature of 358° C. The spinneret holes are arranged in an alternating two-row array, and each hole has a counterbore diameter of 0.055 inch, a capillary diameter of 150 microns, a capillary length of 600 microns (1/d equals 4), and an entrance angle of 135 degrees, as defined in Riggs et al. U.S. Pat. No. 4,576,811 (see particularly, example 2). Between the spinneret and the distribution plate a 0.005 inch thick shim is interposed. The shim has a plurality of 0.008×0.10 inch slots that align with each spinneret hole as shown in FIG. 2. These slots form the pitch into a ribbon-shaped flow configuration to the spinnerets. Filaments are wound at 550 yards per minute in an air media on a standard phenolic spool.

Several skeins were batch stabilized by heating in air. All were heated to 210° C. for 48 minutes. The temperature was then increased in stages to 260° C., then held at 260° C. for an additional period of 1.5 hours.

Graphitization was carried out by forwarding the yarn at 4 feet/minute through a 4 foot long precarbonization oven at 600°-800° C., then through a 9 foot long, carbon-resistance oven having a 1000°-1200° C. entrance zone, a 2550° C. graphitization zone, and an exiting 1000°-1200° C. zone. The fibers were at graphitization temperatures for about 45 seconds. Several skeins of yarn were produced and single fiber tensile properties were determined at 1" gauge length following ASTM 3379 on 30 samples (average diameter was 6.9 microns). The average resulting properties were 499 Kpsi strength, 120 Mpsi modulus and 0.5% elongation. None of the filaments observed in photomicrographic cross-section showed signs of longitudinal cracking. The microstructure of the individual filaments predominantly exhibited a straight line along the center of the cross-section with adjacent lines bowed away from the straight center line near the circumference of the cross section.

To show the influence of spinning temperature and spinneret capillary size, several skeins of graphitized yarn were produced and characterized as above, except that the spinneret diameter was 200 micrometers, the length was 800 micrometers, and the spinneret capillary temperature was 352° C. The resulting yarn exhibited an average diameter of 6.5 micrometers, a strength of 432 Kpsi, a modulus of 108 Mpsi and an elongation of 0.4%. These are appreciable differences.

In an effort to show the influence of the slotted shim, an attempt was made to spin yarn using the spinneret with 200 micrometer diameter capillaries and a spinneret capillary temperature of 352° C. as described above but without the slotted shim. No continuous yarn at the smaller diameter could be obtained at the above conditions without the use of the slotted shim.

EXAMPLE 2

Pitch prepared as described in Example 1 was spun through a 5 inch diameter/500 hole spinneret. The holes were round and were arrayed in 5 concentric rings, 100 holes per ring, located in the outer ½ inch of the spinneret face. Each hole had a counterbore diameter of 0.055 inch, a capillary diameter of 200 micrometers and a capillary length of 800 micrometers. The entrance angle of the spinneret holes was 135°. The spinneret was heated so that the actual spinneret capillary temperature was 364° C. In spite of the higher temperature, because of the use of a spinneret with larger diameter capillaries, the fibers could not be attenuated to the same degree as in example 1 without breaking the fibers. By increasing the rate at which pitch was supplied to the spinneret several bobbins of fibers were produced with acceptable continuity. The fibers were carbonized by forwarding the yarn at 12 feet/minute under the tension of its own weight through a 4 foot long precarbonization oven at 600°-800° C., then through a 9 foot long carbon-resistance oven having a 1000°-1200° C. entrance zone, a carbonization zone and an exiting 1000°-1200° C. zone. The highest temperature to which the yarn was exposed was 2180° C. and the exposure time to this temperature was about 15 seconds. The carbonized yarn was next passed through a 19 foot long chamber containing dried room temperature air admixed with 0.098% ozone supplied at a rate of 1 cfm. The yarn was overlaid with a 1% solution of epoxy resin (CMD-W55-5003, sold by the Celanese Corporation) in water, using the method and apparatus shown in U.S. Pat. No. 4,624,102 (Bell, Jr.). The treated yarns were cured at 350° C. and then cleaned by passing the yarn through a guide described and illustrated in U.S. Pat. No. 4,689,947 (Winkler). The yarn thus produced exhibited an average diameter of 7.2 micrometers, a strength of 482 Kpsi, a modulus of 79 Mpsi and an elongation of 0.6%.

To show the result of using pitch which is more viscous and higher melting, several bobbins of carbonized yarn were produced from a different batch of of the same type pitch produced using a different amount of antisolvent (85:15) such that the resulting mixture was 87:13 by volume of toluene/heptane. Pitch thus produced had a predicted spin temperature of 355° C. versus 348° C. when produced as in example 1. Using this pitch several bobbins of yarn were produced with the spinneret described above in example 2 employing a spinneret capillary temperature of 379° C., 24° C. above the predicted spin temperature of the pitch. Because of the use of pitch with a higher predicted spin temperature, even at the higher spinneret capillary temperature the pitch feed rate had to be increased to avoid breaking the fibers. The resultant fibers were larger in diameter, 8 micrometers, had a strength of 476 Kpsi, a modulus of 71 Mpsi and an elongation of 0.7%. In addition, the spinning continuity was poorer than experienced when using pitch with a lower predicted spin temperature.

We claim:

1. In a process for spinning substantially round cross-section fibers with a diameter of from 3 to 8 micrometers from mesophase pitch having a characteristic predicted spin temperature comprising spinning molten mesophase pitch through a spinneret having a round cross-section discharge capillary and a round cross-section counterbore upstream of the capillary, said counterbore being larger in diameter than said capillary, the improvement comprising using a spinneret having a capillary diameter of from 0.004 to 0.010 inches, and first directing the flow of pitch through an opening upstream of said counterbore, the opening having a high aspect ratio and an area substantially larger than the cross-sectional area of the capillary.

2. The process of claim 1 wherein the aspect ratio of the opening is at least 3:1 and the pitch is spun at a spinneret capillary temperature at least 10° C. higher than said predicted spin temperature.

3. The process of claim 2 wherein the opening has a depth of at least 0.005 inches.

4. The process of claim 1 for spinning fibers with a diameter of from 5 to 8 micrometers wherein the pitch is spun at a spinneret capillary temperature of from 10° to 25° C. higher than the predicted spin temperature, the capillary has a diameter of about 0.005 to 0.007 inches and the opening has a thickness of at least 0.005 inches.

5. The process of claim 4 wherein the opening is rectangular and has an aspect ratio of at least 5:1, and wherein the pitch has an average residence time in the opening of at least 0.03 seconds.

6. The process of claim 5 wherein the smaller dimension of the rectangular opening is approximately equal to the capillary diameter, and wherein the pitch has an average residence time in the opening of about 0.06 to 0.2 seconds.

7. The process of claim 6 wherein the pitch is spun at a spinneret capillary temperature of about 15° C. higher than the predicted spin temperature.

8. The process of claim 7 wherein the pitch has a predicted spin temperature of from 330° to 353° C.

9. The process of claim 7 wherein the pitch has a predicted spin temperature of from 345° to 350° C.

* * * * *